US008394283B2

(12) United States Patent
Kim et al.

(10) Patent No.: US 8,394,283 B2
(45) Date of Patent: Mar. 12, 2013

(54) MANUFACTURING METHOD OF 3D SHAPE STRUCTURE HAVING HYDROPHOBIC EXTERNAL SURFACE

(75) Inventors: Dong-Seob Kim, Pohang (KR); Sang-Min Lee, Pohang (KR); Woon-Bong Hwang, Pohang (KR); Kun-Hong Lee, Pohang (KR); Geun-Bae Lim, Pohang (KR); Joon-Won Kim, Pohang (KR); Dong-Hyun Kim, Seoul (KR); Hyun-Chul Park, Pohang (KR)

(73) Assignee: Postech Academy-Industry Foundation, Pohang (KR)

( * ) Notice: Subject to any disclaimer, the term of this patent is extended or adjusted under 35 U.S.C. 154(b) by 297 days.

(21) Appl. No.: 12/741,058

(22) PCT Filed: Mar. 12, 2008

(86) PCT No.: PCT/KR2008/001399

§ 371 (c)(1),
(2), (4) Date: May 3, 2010

(87) PCT Pub. No.: WO2009/061034

PCT Pub. Date: May 14, 2009

(65) Prior Publication Data

US 2010/0252525 A1 Oct. 7, 2010

(30) Foreign Application Priority Data

Nov. 6, 2007 (KR) ..... 10-2007-0112688

(51) Int. Cl.
*B31D 3/00* (2006.01)

(52) U.S. Cl. ..... 216/56; 216/2

(58) Field of Classification Search ..... 216/56, 216/2

See application file for complete search history.

(56) References Cited

FOREIGN PATENT DOCUMENTS

| | | | |
|---|---|---|---|
| CN | 1072872 | | 6/1993 |
| JP | 56-004430 | | 1/1981 |
| JP | 60208496 | A * | 10/1985 |
| JP | 02-254192 | | 10/1990 |
| JP | 07-0268687 | | 10/1995 |
| JP | 09-155972 | | 6/1997 |
| JP | 10-096599 | | 4/1998 |

(Continued)

OTHER PUBLICATIONS

D. Kim et al.,Superhydrophobic nanostructures based on porous alumina, Current Applied Physics, in Press, Correctd Prrof, Web Publication Date Oct. 10, 2007.

(Continued)

*Primary Examiner* — Roberts Culbert
(74) *Attorney, Agent, or Firm* — Lexyoume IP Meister, PLLC.

(57) ABSTRACT

The present invention relates to a three-dimensional structure manufacturing method for performing surface treatment processes, and a replication step to provide hydrophobicity on an external surface of the three-dimensional structure. In the manufacturing method, the hydrophobicity may be provided to the external surface of the three-dimensional structure, a high cost device required in the conventional MEMS process is not used, the manufacturing cost is reduced, and the manufacturing process is simplified. In addition, it has been difficult to provide the hydrophobicity on an external surface of a three-dimensional structure having a large surface due to a spatial limitation, but in the exemplary embodiment of the present invention, the hydrophobicity may be provided to the external surface of the three-dimensional structure having a large surface, such as a torpedo, a submarine, a ship, and a vehicle, without the spatial limitation.

11 Claims, 8 Drawing Sheets

FOREIGN PATENT DOCUMENTS

| | | |
|---|---|---|
| JP | 63-143290 | 6/1998 |
| JP | 10-278277 | 10/1998 |
| JP | 2004-114392 | 4/2004 |
| JP | 2005-272923 | 10/2005 |
| JP | 2006-095928 | 4/2006 |
| KR | 10-2006-0052327 | 5/2006 |
| WO | 2006/003592 | 1/2006 |
| WO | 2009/017294 | 2/2009 |

OTHER PUBLICATIONS

D. Kim, et al., "Superhydrophobic nanostructures based on porous alumina", Current Applied Physics, North-Holland, vol. 8, No. 6, Oct. 10, 2007, pp. 770-773.

European Patent Office, Supplementary European Search Report for PCT/KR2008001399, Aug. 17, 2011.

* cited by examiner

FIG. 6
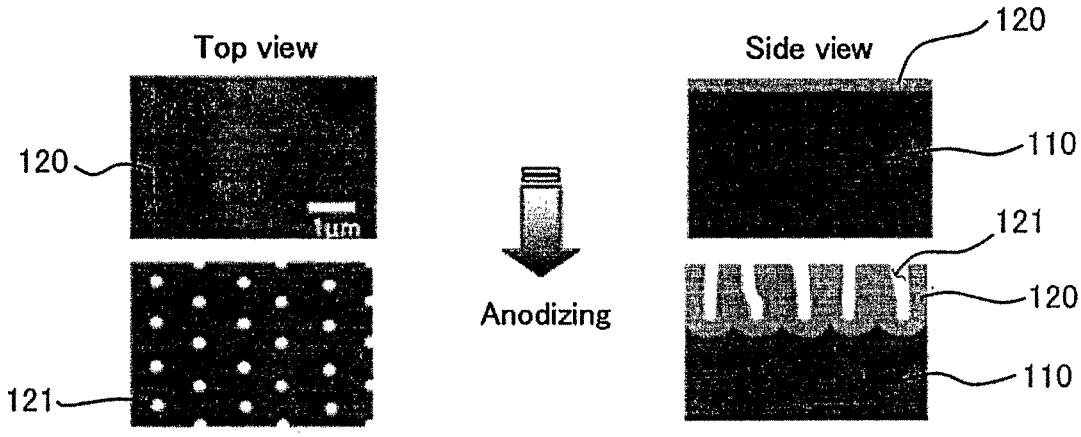
【FIG. 7】
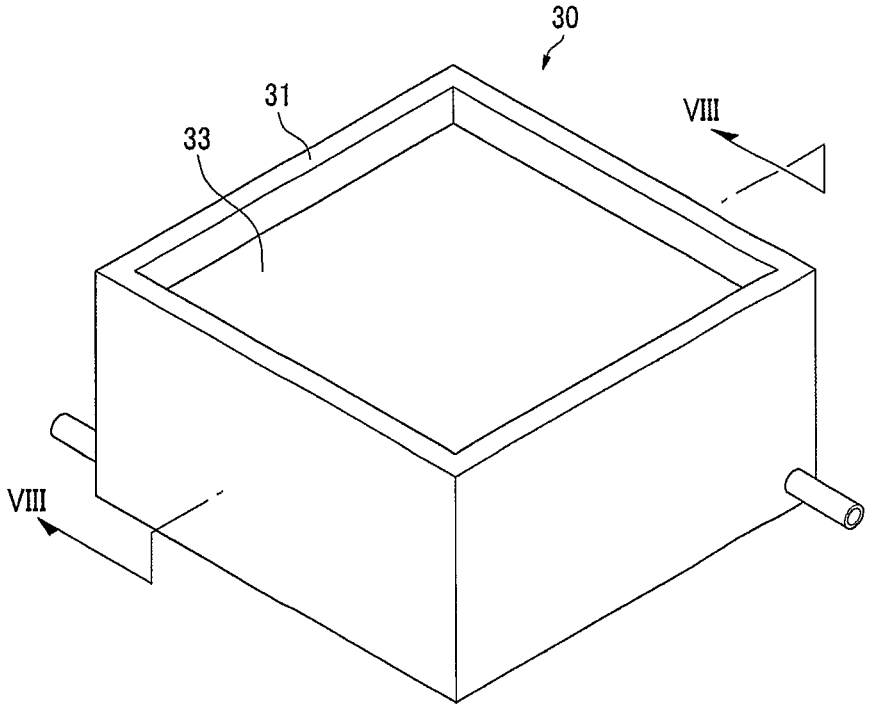

MANUFACTURING METHOD OF 3D SHAPE STRUCTURE HAVING HYDROPHOBIC EXTERNAL SURFACE

CROSS-REFERENCE TO RELATED APPLICATION

This application claims priority to and the benefit of Korean Patent Application No. 10-2007-0112688 filed in the Korean Intellectual Property Office on Nov. 6, 2007, the entire contents of which are incorporated herein by reference.

BACKGROUND OF THE INVENTION (a) Field of the Invention

The present invention relates to a manufacturing method of a three-dimensional structure having a hydrophobic external surface, and more particularly, to a three-dimensional structure manufacturing method for performing surface treatment processes and a replication step to provide hydrophobicity on an external surface of the three-dimensional structure.

(b) Description of the Related Art

Generally, a surface of a solid body formed of a metal or a polymer has an inherent surface energy, which is shown by a contact angle between the solid body and a liquid when the liquid material contacts the solid material. The liquid may include water, oil, and so forth, and hereinafter, water will be exemplified as the liquid. When the contact angle is less than 90°, hydrophilicity in which a sphere shape of a water drop is dispersed on a surface of the solid body to wet the surface is shown. In addition, when the contact angle is greater than 90°, hydrophobicity in which the sphere shape of the water drop is maintained on the surface of the solid body to run on the surface is shown. Aa an example of hydrophobicity, a water drop that runs on the surface of a leaf of a lotus flower flows without wetting the leaf.

Further, when the surface of a solid body is processed so as to have slight protrusions and depressions, the contact angle of the surface may vary. That is, when the surface is processed, the hydrophilicity of a hydrophilic surface with a contact angle that is less than 90° may increase, and the hydrophobicity of a hydrophobic surface with a contact angle that is greater than 90° may increase.

The hydrophilic surface or the hydrophobic surface of the solid body may be applied to various products of a three-dimensional shape. Particularly, since the liquid may not wet the hydrophobic surface and it may easily flow by external force, the amount and the speed of the liquid may increase, and therefore the hydrophobic surface may be applied to various products of a three-dimensional shape.

That is, when the hydrophobic surface is applied to structures such as a torpedo, a submarine, and a ship, flow resistance applied to an outer surface of the structure may be reduced. Accordingly, the structure having the hydrophobic surface may go faster with the same impellent force than a conventional structure. Further, since a flowing speed is high on the hydrophobic surface of the structure, foreign materials may not be accumulated on the surface.

In addition, when the hydrophobic surface is applied to an external surface of a structure such as a vehicle, air resistance may be reduced compared to a conventional structure. Therefore, a vehicle having the hydrophobic surface may go faster with same impellent force than the conventional structure.

Technology for applying the hydrophobic surface to the structure of the three-dimensional shape has depended on a microelectromechanical system (MEMS) process applying a semiconductor fabrication technology. The MEMS process is an advanced mechanical engineering technology applying semiconductor technology. However, the apparatus used for the semiconductor process is very expensive. In order to form the nano-scaled protrusions and depressions on a surface of a solid metal body, a variety of processes that cannot be performed under a normal working environment such as a process for oxidizing the metal surface, a process for applying a constant temperature and a constant voltage, and a process for oxidizing and etching using a special solution, must be performed. That is, in order to perform such processes, a specifically designed clean room is required and a variety of expensive apparatuses for performing the processes are necessary. Even though the hydrophobic surface has various merits, it has not been widely used because of a manufacturing limit of the hydrophobic surface.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a manufacturing method of a three-dimensional structure having a hydrophobic surface formed with a reduced cost and a simplified process.

In addition, the present invention has been made in an effort to provide a manufacturing method of a three-dimensional structure having a hydrophobic external surface that may be applied to external surfaces of a torpedo, a submarine, a ship, and a vehicle.

According to an exemplary embodiment of the present invention, a manufacturing method of a three-dimensional structure having a hydrophobic external surface includes a metal member preparing step for preparing a metal member having an inner space corresponding to a size of the three-dimensional structure, an anodizing step for anodizing the metal member and forming fine holes on an inner surface of the metal member, a replication step for coating a non-wetting polymer material on the inner surface of the metal member and forming the non-wetting polymer material to be a replication structure corresponding to the fine holes, a structure forming step for adhering a structure forming material on an exposed surface of the replication structure in the metal member, and an etching step for etching and eliminating the metal member to obtain a hydrophobic external surface.

The manufacturing method of the three-dimensional structure further includes a particle spraying step for forming fine protrusions and depressions on the inner surface of the metal member, and the particle spraying step is performed between the metal member preparing step and the anodizing step.

In the particle spraying step, fine particles collide against the inner surface of the metal member to form the fine protrusions and depressions.

In the anodizing step, the metal member is immersed in an anodizing device including an electrolyte solution, an electrode is applied to the metal member, and an anode oxide layer having the fine holes is formed. In the anodizing step, an electrolyte solution fills an inner space of the metal member, an electrode is applied to the metal member, and an anode oxide layer having the fine holes is formed.

In the replication step, the non-wetting polymer material is provided to the fine holes of the metal member, and the replication structure has a plurality of columns corresponding to the fine holes. In the replication step, the plurality of columns partially stick to each other to form a plurality of groups.

In the structure forming step, the structure forming material has adhesion to be adhered on a surface contacting the replication structure, and it has flexibility so as to be adhered on a curved surface of the replication structure.

In the etching step, the metal member is wet-etched.

A plurality of structures having the hydrophobic external surfaces may be formed, and the structures may be combined together.

BRIEF DESCRIPTION OF THE DRAWINGS

FIG. 6 is a diagram representing fine holes of the anode oxide layer on a surface of fine protrusions and depressions after the anodizing step is performed on the metal member shown in FIG. 4 or FIG. 5.

FIG. 7 is a schematic diagram representing a step for forming a replication structure corresponding to the fine holes of the anode oxide layer on the inner surface of the metal member.

DETAILED DESCRIPTION OF THE EMBODIMENTS

In the following detailed description, only certain exemplary embodiments of the present invention have been shown and described, simply by way of illustration. As those skilled in the art would realize, the described embodiments may be modified in various different ways, all without departing from the spirit or scope of the present invention.

Figure 1:
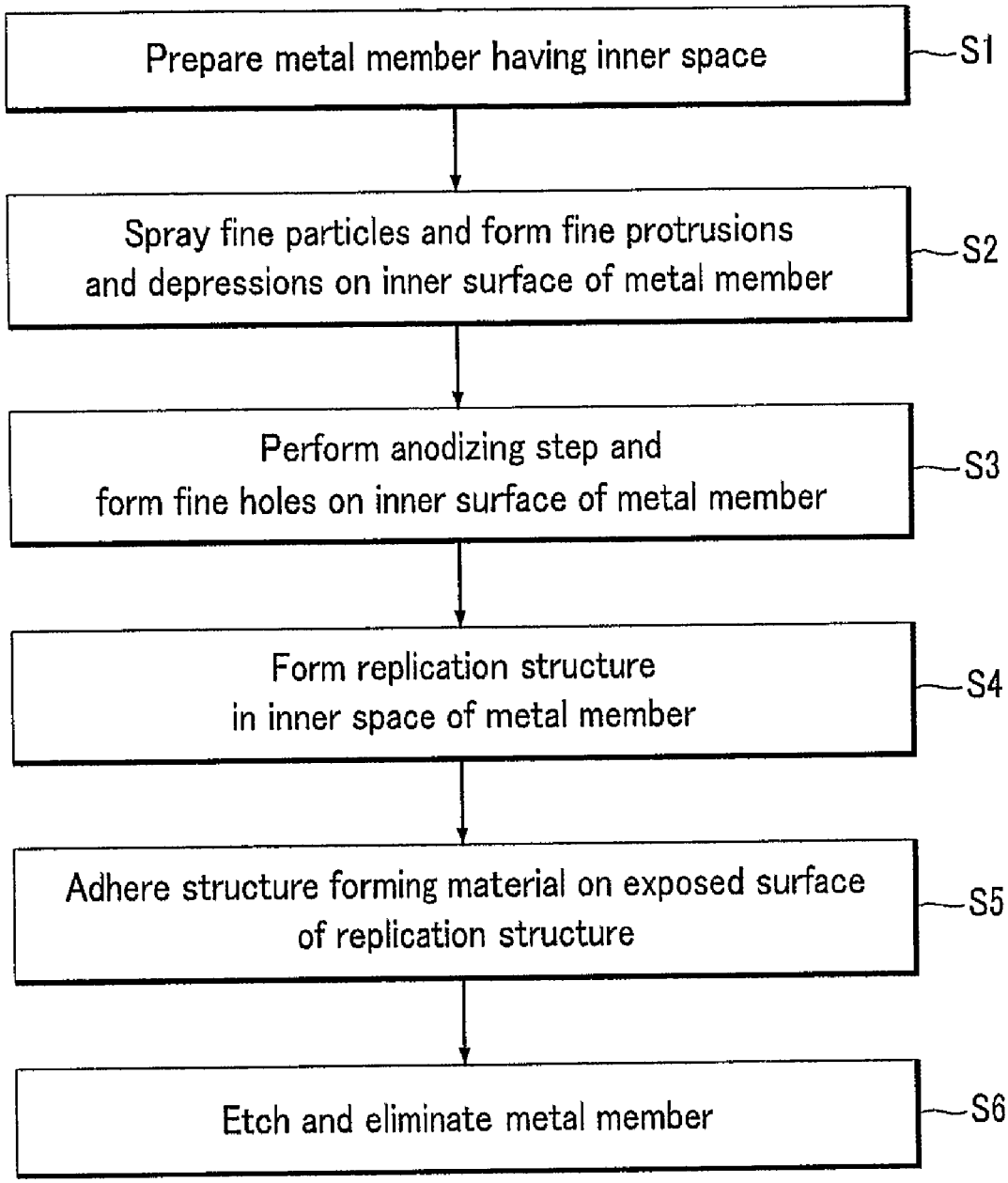
FIG. 1 is a flowchart representing a manufacturing method of a three-dimensional structure having a hydrophobic external surface according to an exemplary embodiment of the present invention.

FIG. 1 is a flowchart representing a manufacturing method of a three-dimensional structure having a hydrophobic external surface according to an exemplary embodiment of the present invention.

As shown in FIG. 1, since a metal member preparing step S1, a small particle spraying step S2, an anodizing step S3, a replication step S4, a structure forming step S5, and a metal member etching step S6 are performed in the manufacturing method of the structure having the hydrophobic inner surface according to the exemplary embodiment of the present invention, the structure having the hydrophobic inner surface may be simply manufactured with a reduced cost compared to a conventional microelectromechanical system (MEMS) process. Further, in the manufacturing method according to the exemplary embodiment of the present invention, hydrophobicity may be realized at an external surface of any three-dimensional structure.

Figure 2:
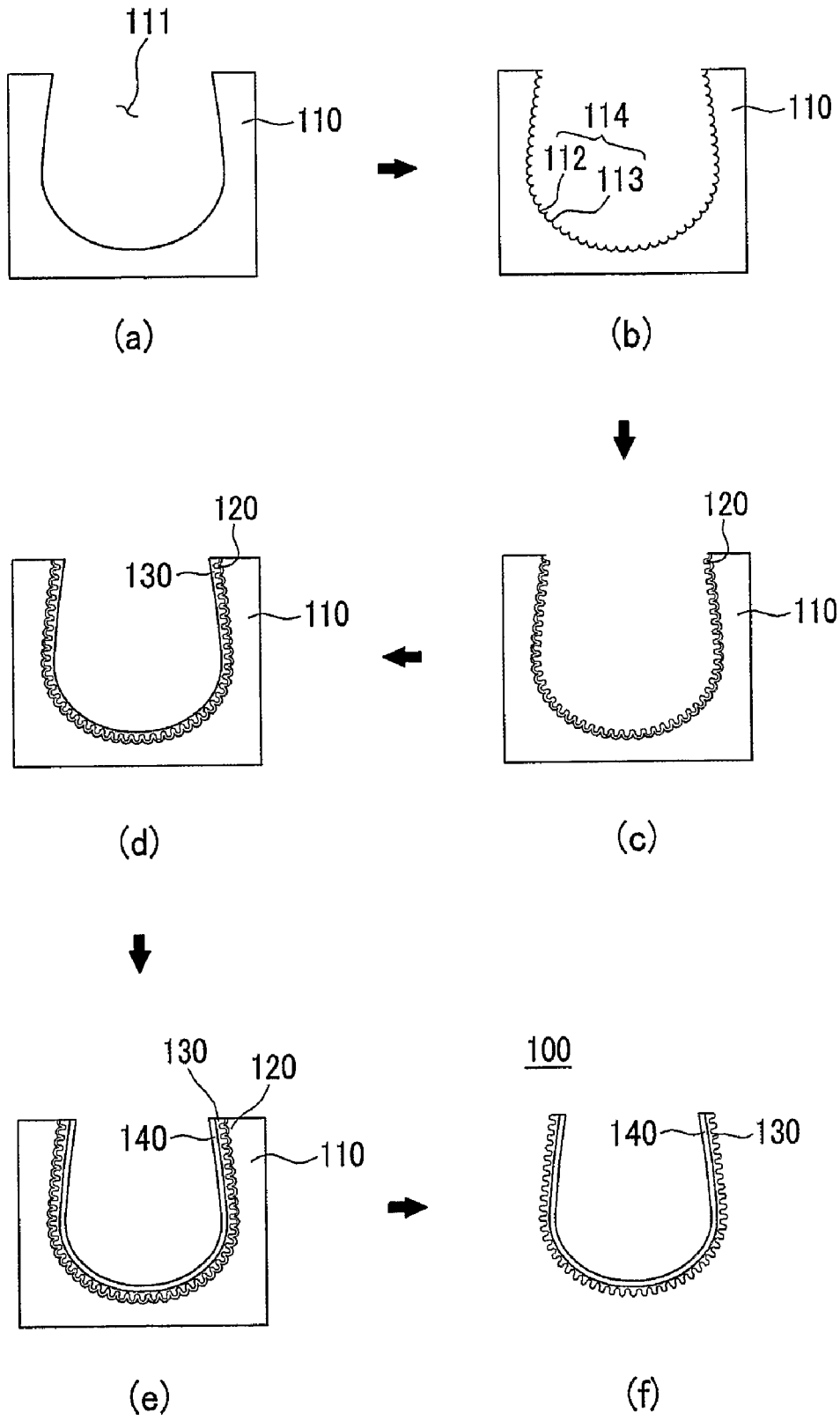
FIG. 2 is a schematic diagram representing images of the manufacturing method shown in FIG. 1.

FIG. 2 is a schematic diagram representing images of the manufacturing method shown in FIG. 1.

As shown in FIG. 2, in the manufacturing method of the three-dimensional structure, a metal member 110 having an inner space 111 corresponding to a size of the three-dimensional structure is provided. That is, the metal member 110 functions as a mold frame of the three-dimensional structure, and the inner space 111 has an inner surface that is the same as an external shape of the three-dimensional structure.

In a preliminary process of the manufacturing method according to the exemplary embodiment of the present exemplary embodiment, the inner surface of the metal member 110 is electro-polished by using a solution obtained by combining perchloric acid and ethanol in a volume ratio of 1:4, and the inner surface of the metal member 110 is planarized.

Figure 3:
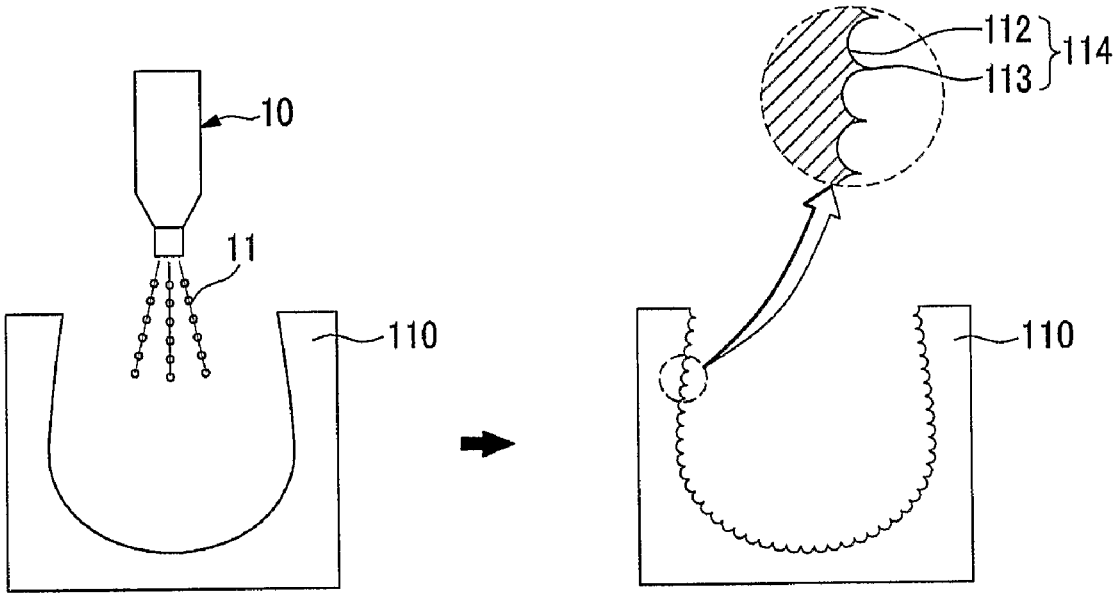
FIG. 3 is a schematic diagram representing a step for forming fine protrusions and depressions on an inner surface of a metal member shown in FIG. 2(*b*).

FIG. 3 is a schematic diagram representing a step for forming fine protrusions and depressions on the inner surface of the metal member shown in FIG. 2(*b*).

As shown in FIG. 1, FIG. 2, and FIG. 3, in the manufacturing method of the three-dimensional structure, fine particles 11 are sprayed to form the fine protrusions and depressions 114 on the inner surface of the metal member 110 in a small particle spraying step S2. A particle spraying unit 10 is used to perform the small particle spraying step S2. The particle spraying unit 10 sprays the fine particles 11 to the inner surface of the metal member 110 with a predetermined speed and a predetermined pressure.

The spraying speed and pressure of the fine particles 11 may vary according to a design size of the fine protrusions and depressions 114 that are to be formed on the metal member 110. That is, a scale of the fine protrusions and depressions 114 is determined by the depth of depressions ⊔ 112 and the height of protrusions (⊓) 113, or the distance between the protrusions (⊓) 113. The scale of the fine protrusions and depressions 114 may vary according to a spray speed and a spray pressure of the particle spraying unit 10, and the size of the fine particles 11, the spray speed and pressure, and the size of the fine particles that affect the scale of the fine protrusions and depressions 114 are previously designed, and therefore the size of fine particles 11 may be varied.

The fine particles 11 impact against the inner surface of the metal member 110, and the fine protrusions and depressions 114 are formed on the inner surface of the metal member 110 by the impact energy. In this case, it is required to evenly spray the fine particles 11 on the inner surface of the metal member 110 to uniformly form the fine protrusions and depressions 114 on the inner surface of the metal member 110.

A sand blaster for spraying sand particles is used as the particle spraying unit 10 according to the exemplary embodiment of the present invention to spray small particles such as metal balls rather than sand particles.

Figure 4:
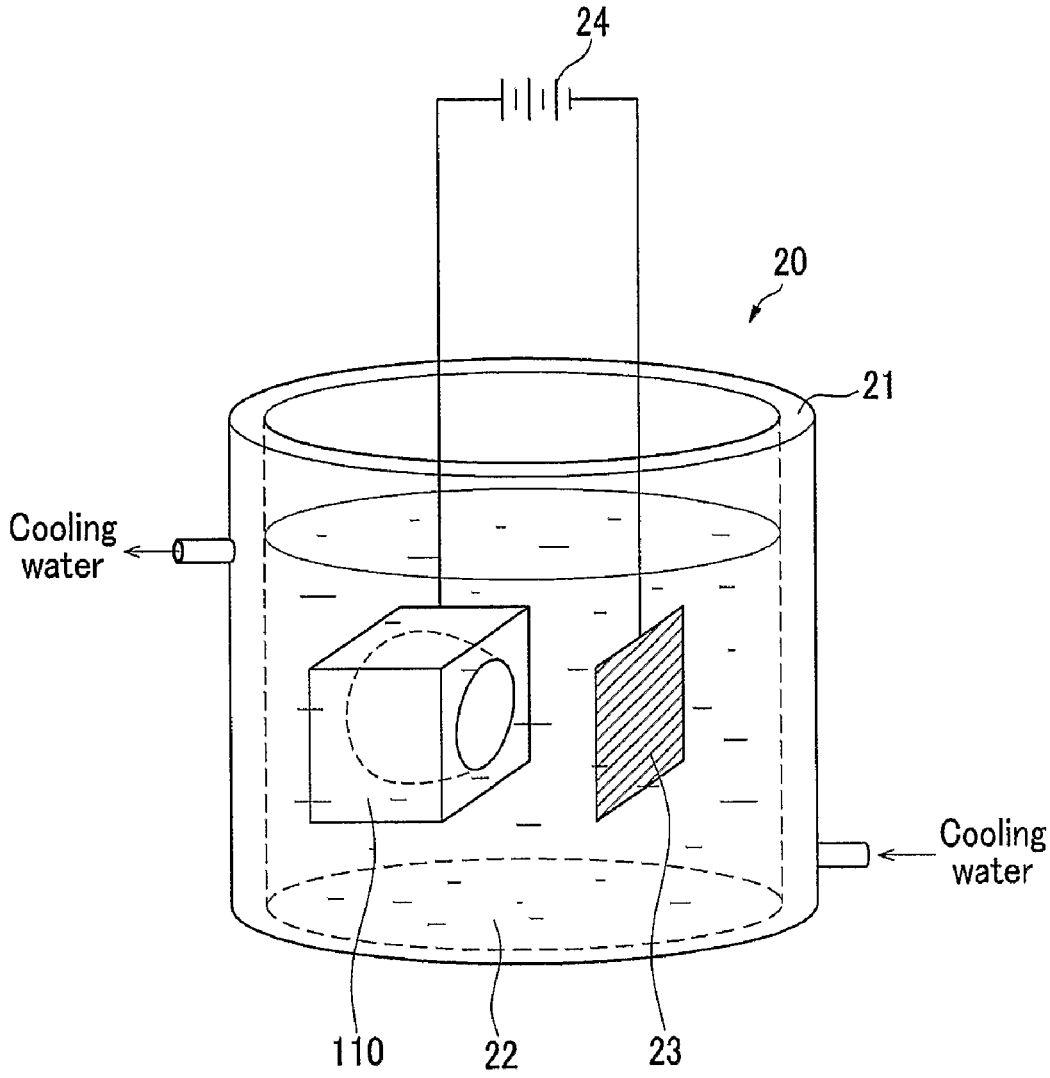
FIG. 4 is a schematic diagram representing a step for forming an anode oxide layer on the inner surface of the metal member in an anodizing step shown in FIG. 2(*c*).

FIG. 4 is a schematic diagram representing a step for forming an anode oxide layer on the inner surface of the metal member in an anodizing step shown in FIG. 2(*c*).

As shown in FIG. 1, FIG. 2, and FIG. 4, in the manufacturing method of the three-dimensional structure, the anodizing step S3 for anodizing the metal member 110 to form the fine holes on the inner surface of the metal member 110 is performed. When the metal member 110 is immersed in an electrolyte solution 22 and an electrode is applied in the anodizing step, an anode oxide layer 120 having the fine holes is formed on the inner surface of the metal member 110. Accordingly, in the anodizing step, the nanometer-scale fine holes that are finer than the fine protrusions and depressions 114 formed on the metal member 110 may be formed.

An anodizing device 20 shown in FIG. 4 is used to perform the anodizing step in the exemplary embodiment of the present invention. An electrolyte solution 22 (e.g., 0.3M oxalic acid $C_2H_2O_4$ or phosphoric acid) is provided in an inner storage space of a main body 21 of the anodizing device 20, and the metal member 110 and another metal member 23 are immersed in the electrolyte solution 22. The anodizing device 20 includes a power supply unit 24, the metal member 110 is connected to one of an anode electrode and a cathode electrode of the power supply unit 24, and a metal member 23 of a platinum material is connected to the other electrode of the power supply unit 24. Here, any material may be used for the metal member 23 if the material is a conductor to which a power source may be applied. Subsequently, while the metal member 110 and the metal member 23 are maintained to have a predetermined distance therebetween, the power supply unit 24 applies a predetermined constant voltage. In this case, the electrolyte solution 22 is maintained at a predetermined temperature (e.g., 15° C.), and a stirrer is used to stir the solution so as to prevent deflection of solution concentration. Thereby, alumina as the anode oxide layer 120 is formed on the metal member 110. The metal member 110 is removed from the electrolyte solution 22 after the anodizing step, the metal member is washed in deionized water for a predetermined time, and it is dried at a predetermined temperature for a predetermined time (e.g., approximately one hour).

Thereby, not only are the fine protrusions and depressions 114 formed on the metal member 110 in the small particle spraying step S2, but also nanometer-scale fine holes 121 that are finer than the fine protrusions and depressions 114 formed on the anode oxide layer 120 in the anodizing step S2, as shown in FIG. 6.

Figure 5:
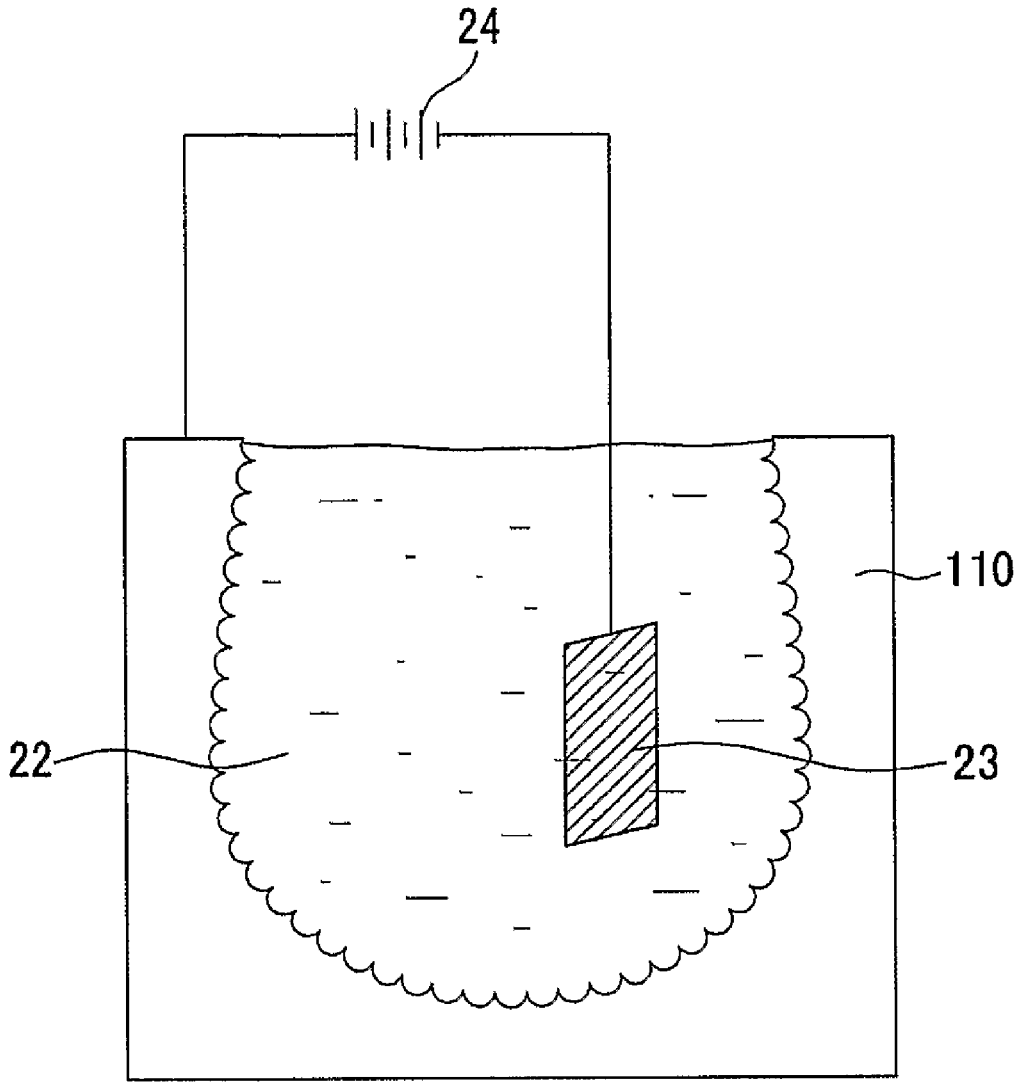
FIG. 5 is a schematic diagram representing a step for forming the anode oxide layer on the inner surface of the metal member by performing another anodizing step.

FIG. 5 is a schematic diagram representing a step for forming the anode oxide layer on the inner surface of the metal member by performing another anodizing step.

As shown in FIG. 1, FIG. 2, and FIG. 5, in the manufacturing method of the three-dimensional structure, when the metal member 110 is larger than a predetermined size, the anodizing device 20 shown in FIG. 4 may not contain the metal member 110. In this case, in the manufacturing method of the three-dimensional structure, the electrolyte solution 22 fills the inner space 111 of the metal member 110 to perform the anodizing step. That is, in the manufacturing method of the three-dimensional structure, the metal member 110 and the metal member 23 of the platinum material are respectively connected to the polarities of the power supply unit 24, and a constant voltage is applied. As described, as shown in FIG. 5, in the manufacturing method of the three-dimensional structure, the anodizing step may be performed without having an additional anodizing device, and the anodizing step is not performed with respect to an area except for the inner space 111 of the metal member 110. Thereby, in the manufacturing method of the three-dimensional structure, the anode oxide layer 120 having the fine holes 121 having the nanometer-scale fine holes that are finer than the fine protrusions and depressions 114 formed on the metal member 110 may be formed in the step shown in FIG. 5.

Figure 8:
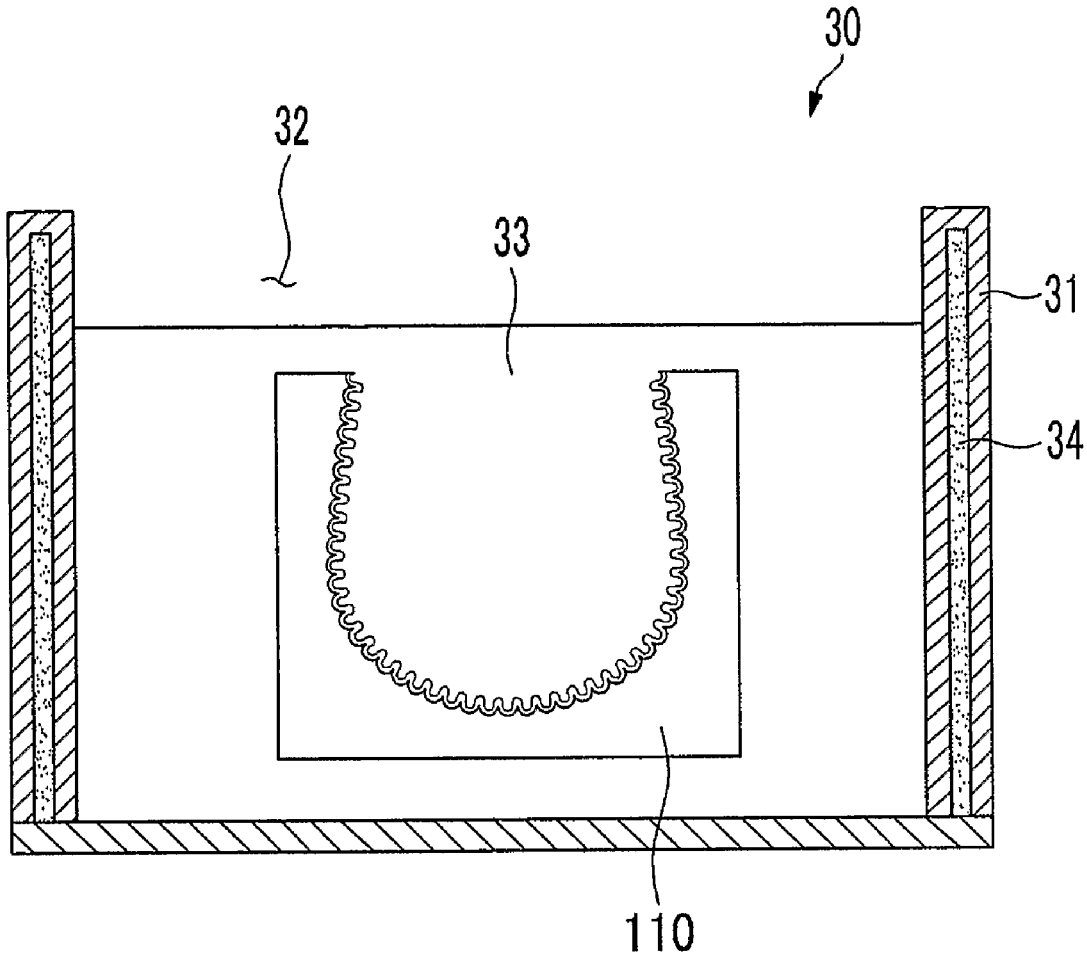
FIG. 8 is a cross-sectional view representing a replication device along a line VIII-VIII shown in FIG. 7.

FIG. 7 is a schematic diagram representing a step for forming a replication structure corresponding to the fine holes of the anode oxide layer on the inner surface of the metal member, and FIG. 8 is a cross-sectional view representing a replication device along a line VIII-VIII shown in FIG. 7.

As shown in FIG. 1, FIG. 2, FIG. 7, and FIG. 8, in the manufacturing method of the three-dimensional structure, the replication step S4 for coating a non-wetting polymer material on the inner space of the metal member 110 to form the non-wetting polymer material to be a replication structure 130 corresponding to the fine holes 121 of the metal member 110 is performed.

The replication device 30 includes a body 31, a storage portion 32 having a predetermined storage space in the body 31, a non-wetting polymer solution 33 provided in the storage portion 32, and a cooling unit 34 provided on side surfaces of the body 31 to solidify the non-wetting polymer solution 33 of the storage portion 32.

In the replication device 30, the metal member 110 is immersed as a replication frame in the non-wetting polymer solution 33, and the non-wetting polymer material is coated on the external surface of the metal member 110. That is, the non-wetting polymer solution 33 is provided into the fine holes 121 of the metal member 110, and the non-wetting polymer material around the metal member 110 is solidified by the cooling unit 34 of the replication device 30. As described, in the manufacturing method of the three-dimensional structure, since the non-wetting polymer material is coated on the inner surface of the metal member 110, the non-wetting polymer material forms the replication structure 130 having a cathode shape surface corresponding to a shape of the fine holes 121. That is, since the replication structure 130 has an anode shape surface corresponding to a cathode shape of the fine holes 121, the replication structure 130 has a plurality of columns.

In this case, the non-wetting polymer solution 33 is formed of at least one material among polytetrafluoroethylene (PTFE), a fluorinated ethylene propylene (FEP) copolymer, and a perfluoroalkoxy (PFA).

However, when the metal member 110 is larger than a predetermined size in the replication step S4 of the manufacturing method of the three-dimensional structure, the replication device 30 shown in FIG. 7 may not contain the metal member 110. In this case, in the manufacturing method of the three-dimensional structure, the non-wetting polymer solution 33 fills the inner space 111 of the metal member 110, and the non-wetting polymer solution 33 is cooled down by a temperature established for the metal member 110 to solidify the non-wetting polymer material. As described, in the manufacturing method of the three-dimensional structure, the replication structure 130 may be formed on the anode oxide layer 120 of the metal member 110 without an additional replication device 30.

Subsequently, in the manufacturing method of the three-dimensional structure, as shown in FIG. 2(*e*), the structure forming step S5 for adhering a structure forming material 140 on an exposed surface of the replication structure 130 is performed. The structure forming material 140 has adhesion to be adhered on a surface contacting the replication structure 130, and it has flexibility so as to be adhered on the curved surface of the replication structure 130. That is, to apply the manufacturing method of the three-dimensional structure to a three-dimensional shape such as a torpedo, a submarine, a ship, and a vehicle, it is required to use a material for being flexibly adhered on external sections of the three-dimensional structure. An acryl film may be used for the structure forming material 140, but it is not limited thereto, and various materials for being flexibly adhered on the sections of the three-dimensional structure may be used.

Subsequently, in the manufacturing method of the three-dimensional structure, as shown in FIG. 2(*f*), the etching step S6 for etching the metal member 110 and the anode oxide layer 120 is performed, and therefore a structure 100 having a hydrophobic external surface formed of the replication structure 130 and the structure forming material 140 is obtained.

In the etching step, the metal member 110 and the anode oxide layer 120 are removed. Therefore, according to the exemplary embodiment of the present invention, as shown in FIG. 2(*f*), the replication structure 130 and the structure forming material 140 remain, the structure 100 having the hydrophobic external surface includes the plurality of columns on the replication structure 130, and the plurality of columns partially stick to each other to form a plurality of groups. That is, since the inner surface of the replication structure 130 is formed in a section that is the same as that of a leaf of a lotus flower, hydrophobicity of minimized hydrophilicity is provided, and therefore a contact angle with a liquid is considerably increased to be greater than 160°.

Figure 9:
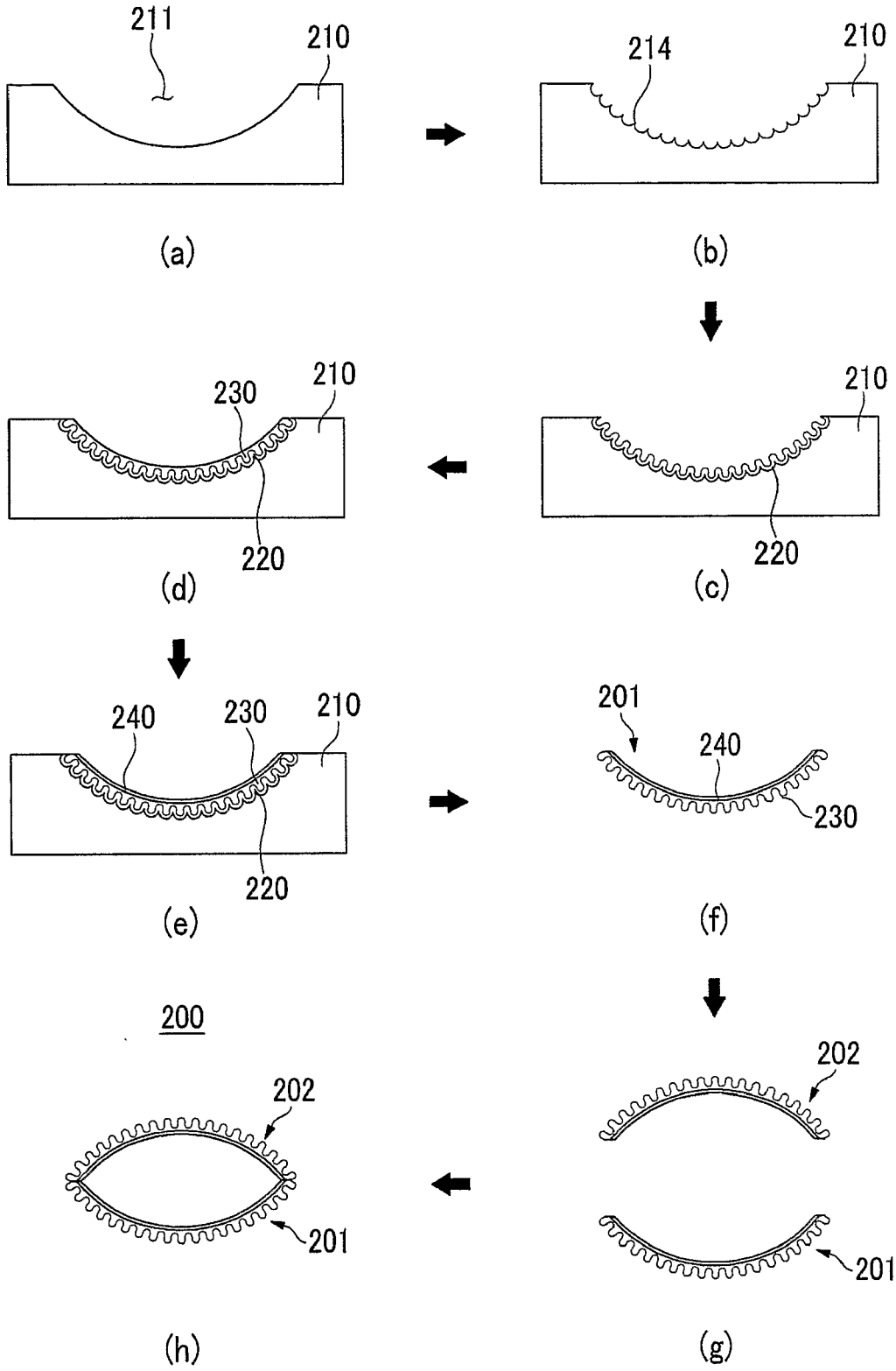
FIG. 9 is a schematic diagram representing steps of the manufacturing method shown in FIG. 1, and FIG. 9 further shows a step for adhering the structures having the hydrophobic external surfaces together.

FIG. 9 is a schematic diagram representing steps of the manufacturing method shown in FIG. 1, and FIG. 9 further shows a step for adhering the structures having the hydrophobic external surfaces together.

The manufacturing method of the three-dimensional structure shown in FIG. 9 basically has the same steps shown in FIG. 1 except that a metal member 210 has a shape that is different from the metal member 110 shown in FIG. 2. That is, the metal member 210 has an inner space 211 corresponding to a part of the manufactured three-dimensional structure. In the manufactured three-dimensional structure, a fine particle spraying step shown in FIG. 9(*b*), an anodizing step shown in FIG. 9(*c*), a replication step shown in FIG. 9(*d*), a structure forming step shown in FIG. 9(*e*), and an etching step shown in FIG. 9(*f*) are performed to form a structure 201 having a hydrophobic external surface. The structure 201 having the hydrophobic external surface is a part of the three-dimensional structure to be manufactured. Accordingly, in the manufacturing method of the three-dimensional structure, a plurality of structures 201 and 202 having the hydrophobic external surfaces are manufactured, the structures 201 and 202 are adhered together, and finally, a three-dimensional structure 200 is manufactured.

Here, reference numeral 220 denotes an anode oxide layer, reference numeral 230 is a replication structure, and reference numeral 240 is a structure forming material.

As described, according to the exemplary embodiment of the present invention, the hydrophobicity may be provided to an external surface of a three-dimensional structure, the high cost device required for the conventional MEMS process is not incurred, the manufacturing cost is reduced, and the manufacturing process is simplified.

In addition, it has been difficult to provide the hydrophobicity on an external surface of a three-dimensional structure having a large surface due to spatial limitations, but in the exemplary embodiment of the present invention, the hydrophobicity may be provided to the external surface of a three-dimensional structure having the large surface, such as a torpedo, a submarine, a ship, and a vehicle, without the spatial limitation.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A manufacturing method of a three-dimensional structure having a hydrophobic external surface, comprising:

preparing a metal member having an inner space corresponding to a size of the three-dimensional structure;

anodizing the metal member and forming fine holes on an inner surface of the metal member;

forming a replica by coating a non-wetting polymer material on the inner surface of the metal member and forming the non-wetting polymer material to be a replication structure corresponding to the fine holes;

forming a structure by adhering a structure forming material on an exposed surface of the replication structure in the metal member; and etching and eliminating the metal member to obtain a hydrophobic external surface, wherein an electrolyte solution fills the inner space of the metal member, an electrode is applied to the metal member, and an anode oxide layer having the fine holes is formed, wherein the structure forming material has adhesion to be adhered on a surface contacting the replication structure.

2. The manufacturing method of claim 1, further comprising spraying particle to form fine protrusions and depressions on the inner surface of the metal member.

3. The manufacturing method of claim 2, wherein fine particles collide against the inner surface of the metal member to form the fine protrusions and depressions.

4. The manufacturing method of claim 1, wherein the electrolyte solution is one among an oxalic acid $C_2H_2O_4$ solution and a phosphoric acid solution.

5. The manufacturing method of claim 1, wherein the non-wetting polymer material is provided to the fine holes of the metal member, and the replication structure has a plurality of columns corresponding to the fine holes.

6. The manufacturing method of claim 5, wherein the plurality of columns partially stick to each other to form a plurality of groups.

7. The manufacturing method of claim 6, wherein a non-wetting polymer solution is formed of at least one material among polytetrafluoroethylene (PTFE), a fluorinated ethylene propylene (FEP) copolymer, and a perfluoroalkoxy (PFA).

8. The manufacturing method of claim 1, wherein the structure forming material has flexibility so as to be adhered on a curved surface of the replication structure.

9. The manufacturing method of claim 1, wherein the metal member is wet-etched.

10. The manufacturing method of claim 1, wherein a plurality of structures having the hydrophobic external surfaces are formed, and the structures are combined together.

11. The manufacturing method of claim 1, wherein the metal member is not immersed in an anodizing device when the metal member is anodized.

* * * * *